US008276416B2

(12) United States Patent
Boesel et al.

(10) Patent No.: US 8,276,416 B2
(45) Date of Patent: Oct. 2, 2012

(54) MASTER KEY LOCK, SYSTEM AND METHOD

(75) Inventors: Lucas Boesel, Muskego, WI (US); Joshua J. Miller, Milwaukee, WI (US)

(73) Assignee: VSI, LLC, Green Bay, WI (US)

( * ) Notice: Subject to any disclaimer, the term of this patent is extended or adjusted under 35 U.S.C. 154(b) by 171 days.

(21) Appl. No.: 12/708,126

(22) Filed: Feb. 18, 2010

(65) Prior Publication Data

US 2010/0206025 A1 Aug. 19, 2010

Related U.S. Application Data

(60) Provisional application No. 61/153,513, filed on Feb. 18, 2009.

(51) Int. Cl.
*E05B 35/10* (2006.01)
*E05B 29/04* (2006.01)

(52) U.S. Cl. ..... 70/358; 70/337; 70/372; 70/421; 70/492

(58) Field of Classification Search ..... 70/337–343, 70/358, 492, 360, 361, 421, 495, 387, 372, 70/377
See application file for complete search history.

(56) References Cited

U.S. PATENT DOCUMENTS

| | | | | | |
|---|---|---|---|---|---|
| 1,456,584 | A | * | 5/1923 | Bell | 70/340 |
| 1,990,794 | A | * | 2/1935 | McCormac | 70/368 |
| 2,117,515 | A | * | 5/1938 | Sinner | 70/340 |
| 2,683,978 | A | * | 7/1954 | Jacobi | 70/360 |
| 3,194,034 | A | * | 7/1965 | Leiser | 70/358 |
| 3,499,209 | A | * | 3/1970 | Laviana | 29/437 |
| 3,555,859 | A | * | 1/1971 | Berkowitz | 70/340 |
| 4,280,349 | A | * | 7/1981 | Grabner et al. | 70/358 |
| 4,351,171 | A | * | 9/1982 | Tsui | 70/339 |
| 4,682,484 | A | * | 7/1987 | Yeh | 70/492 |
| 4,759,204 | A | * | 7/1988 | Neyret | 70/360 |
| 4,956,983 | A | * | 9/1990 | Okamura et al. | 70/241 |
| 5,070,716 | A | * | 12/1991 | Whorlow | 70/492 |
| 5,263,348 | A | * | 11/1993 | Wittwer | 70/379 R |
| 5,265,453 | A | * | 11/1993 | Konii et al. | 70/379 R |
| RE35,518 | E | * | 5/1997 | Sussina | 70/369 |
| 5,640,864 | A | * | 6/1997 | Miyamoto | 70/379 R |
| 5,722,275 | A | * | 3/1998 | Price et al. | 70/379 R |
| 5,732,580 | A | * | 3/1998 | Garnault et al. | 70/422 |
| 6,463,774 | B2 | * | 10/2002 | Sokurenko | 70/360 |
| 6,516,643 | B1 | * | 2/2003 | Olshausen | 70/337 |
| 6,523,382 | B1 | * | 2/2003 | Dimig et al. | 70/496 |
| 6,826,936 | B1 | * | 12/2004 | Ming-Er et al. | 70/360 |
| 6,886,381 | B2 | * | 5/2005 | Geurden | 70/360 |
| 6,889,534 | B2 | * | 5/2005 | Koluch | 70/493 |

(Continued)

*Primary Examiner* — Lloyd Gall
(74) *Attorney, Agent, or Firm* — Joseph S. Heino; Patrick M. Bergin

(57) ABSTRACT

A master key lock includes a lock cylinder having a keyway for receiving a key, a sleeve about the cylinder, a plurality of wafer tumblers, a master key and a spring operable to axially move the sleeve relative to the cylinder when the master key is inserted into the keyway. A system that uses the master key lock includes a lock case wherein the sleeve is disposed between the cylinder and the lock case, the sleeve being axially movable within the case. The sleeve comprises a plurality of transversely disposed slots for engaging the plurality of wafer tumblers such that the lock is unlocked by insertion of a key or a master key. A method of using the master key lock is also disclosed.

8 Claims, 20 Drawing Sheets

U.S. PATENT DOCUMENTS

| | | | | |
|---|---|---|---|---|
| 6,920,770 | B2 * | 7/2005 | Lurie et al. | 70/100 |
| 6,964,184 | B1 * | 11/2005 | Gregory | 70/360 |
| 6,968,717 | B2 * | 11/2005 | Suzuki et al. | 70/492 |
| 7,205,492 | B1 * | 4/2007 | Corcino et al. | 200/43.13 |
| 7,340,929 | B1 * | 3/2008 | Christopoulos | 70/358 |
| 7,377,142 | B2 * | 5/2008 | Rajacic | 70/186 |
| 7,406,847 | B2 * | 8/2008 | Yuhi et al. | 70/360 |
| 7,716,960 | B2 * | 5/2010 | Tamezane et al. | 70/361 |
| 7,895,868 | B2 * | 3/2011 | Yamaguchi et al. | 70/392 |
| 7,930,917 | B2 * | 4/2011 | Katagiri et al. | 70/387 |
| 7,958,759 | B2 * | 6/2011 | Herdman | 70/371 |
| 7,963,133 | B2 * | 6/2011 | Tamezane | 70/210 |
| 2003/0172695 | A1 * | 9/2003 | Buschmann | 70/361 |
| 2006/0201216 | A1 * | 9/2006 | Gil | 70/492 |

* cited by examiner

MASTER KEY LOCK, SYSTEM AND METHOD

This application claims the benefit and priority of U.S. Provisional Patent Application No. 61/153,513 filed Feb. 18, 2009.

FIELD OF THE INVENTION

This invention relates generally to locks, lock systems and methods of operating locks. More particularly, this invention relates to a master key lock and a master keying system that allows the lock to be unlocked with an original key as well as with a master key. Further, this invention particularly relates to a method for operating such a master key lock and system.

BACKGROUND OF THE INVENTION

In the art of locks, wafer tumbler locks are well known. A wafer tumbler lock is a type of lock that uses a set of flat tumblers or "wafers" to prevent the lock from opening unless the correct key is used in combination with the lock. In such locks, the tumblers are typically rectangularly-shaped single piece structures that fit into, and are movable within, slots that are defined within a lock cylinder. Each tumbler is spring-loaded which biases the tumbler in one direction or another which, in turn, causes it to protrude from the cylinder and into longitudinally-formed, or axially-formed, grooves defined within an outer casing of the lock. As long as one end of one of the tumblers protrudes into one of the grooves, rotation of the cylinder is prevented and the lock remains locked. A rectangular hole or "window" is formed in the center of each tumbler to allow passage of a key through the hole. The vertical position of the hole is intentionally varied between tumblers so that a key must have notches that correspond to the height of the hole in each tumbler such that each tumbler is pulled inwardly to the point where the tumbler edges are flush with the outer surface of the lock cylinder and clear the way for the cylinder to rotate within the casing. If any tumbler is insufficiently raised, or raised too much, a tumbler edge will be situated within the groove of the casing thereby preventing rotation of the cylinder within the casing. Such would be the case where no key is inserted into the lock or where the use of an improperly profiled key is inserted.

These inventors are aware of the need to provide such a wafer tumbler lock with a master key capability for the purpose of allowing locks to use multiple keys and master keys without requiring the lock to be fabricated through the coordination of a large number of different part numbers used in the lock. These inventors are also aware of the need to provide such a lock that is "backwards compatible" with existing locks. Accordingly, it is an object of the present invention to provide a new and useful master keying lock, system and method that would provide a lock that can be unlocked with an original key provided for the lock as well as with one or more master keys. It is another object of the present invention to provide such a lock that utilizes existing tumblers and lock keys to accomplish that functionality. It is still another object of the present invention to provide such a lock which is also more secure and less prone to being "picked" because the sleeve within the system cannot be pushed back into the lock case without use of a master key.

SUMMARY OF THE INVENTION

The master keying lock, system and method of the present invention has obtained these objects. It provides for a master keying system that allows the lock to be unlocked with the original key provided for the lock as well as with a master key. The system and method of the present invention utilizes the existing tumblers and key of the lock. The fundamental principle behind the present invention is that the master keying feature is accomplished by use of a movable sleeve that shifts the locking surface within the casing relative to the wafer tumblers used within the lock.

The foregoing and other features of the present invention will be apparent from the detailed description that follows.

DETAILED DESCRIPTION

Figure 1:
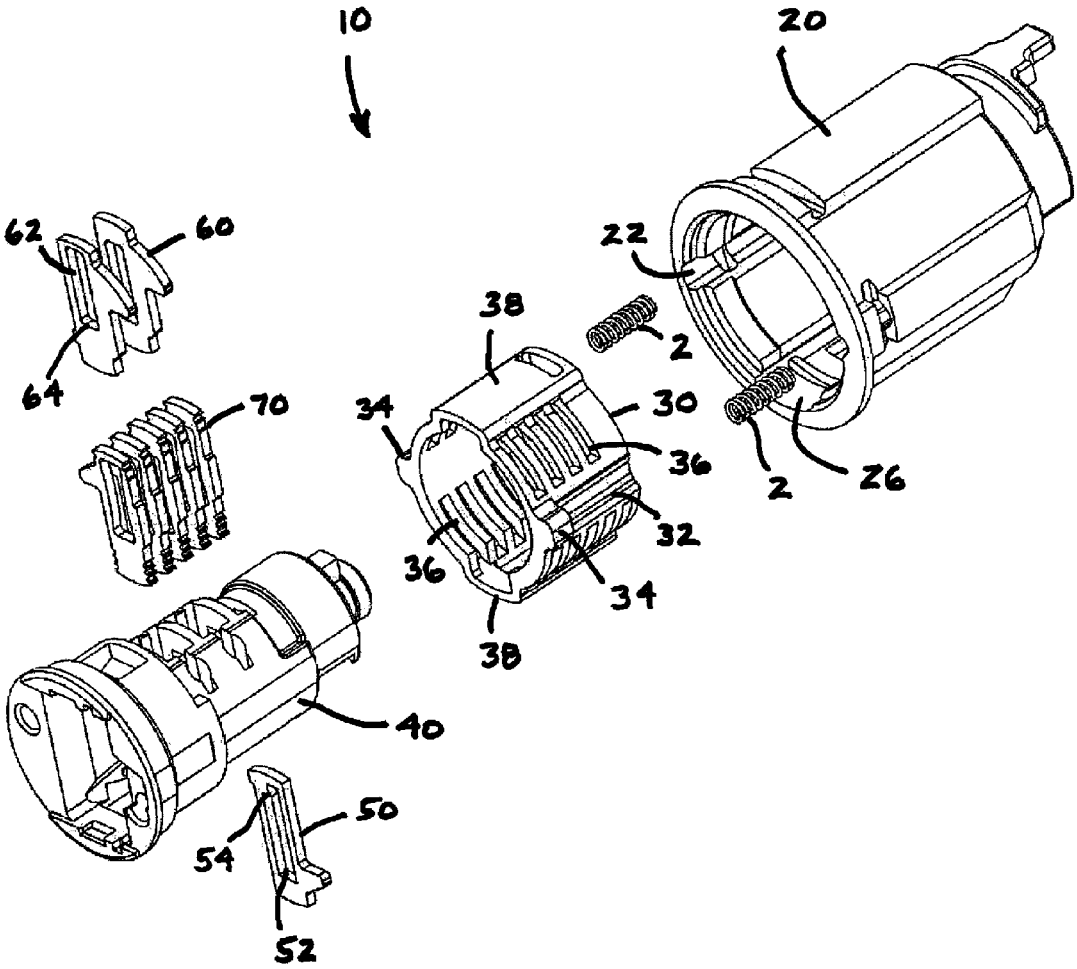
FIG. 1 is an exploded front, top and right side perspective view of the first embodiment of a master keying lock constructed in accordance with the present invention.

Referring now to the drawings in detail wherein like numbers represent like elements throughout, FIG. 1 illustrates a perspective view of the first preferred embodiment of a master keying system, generally identified 10, that is constructed in accordance with the present invention. It is to be understood that the instant invention is not limited to any particular application and may be incorporated into any number of lock assemblies for doors, devices, containers, motor vehicles, and the like, the application not being a limitation of the present invention.

Figure 2:
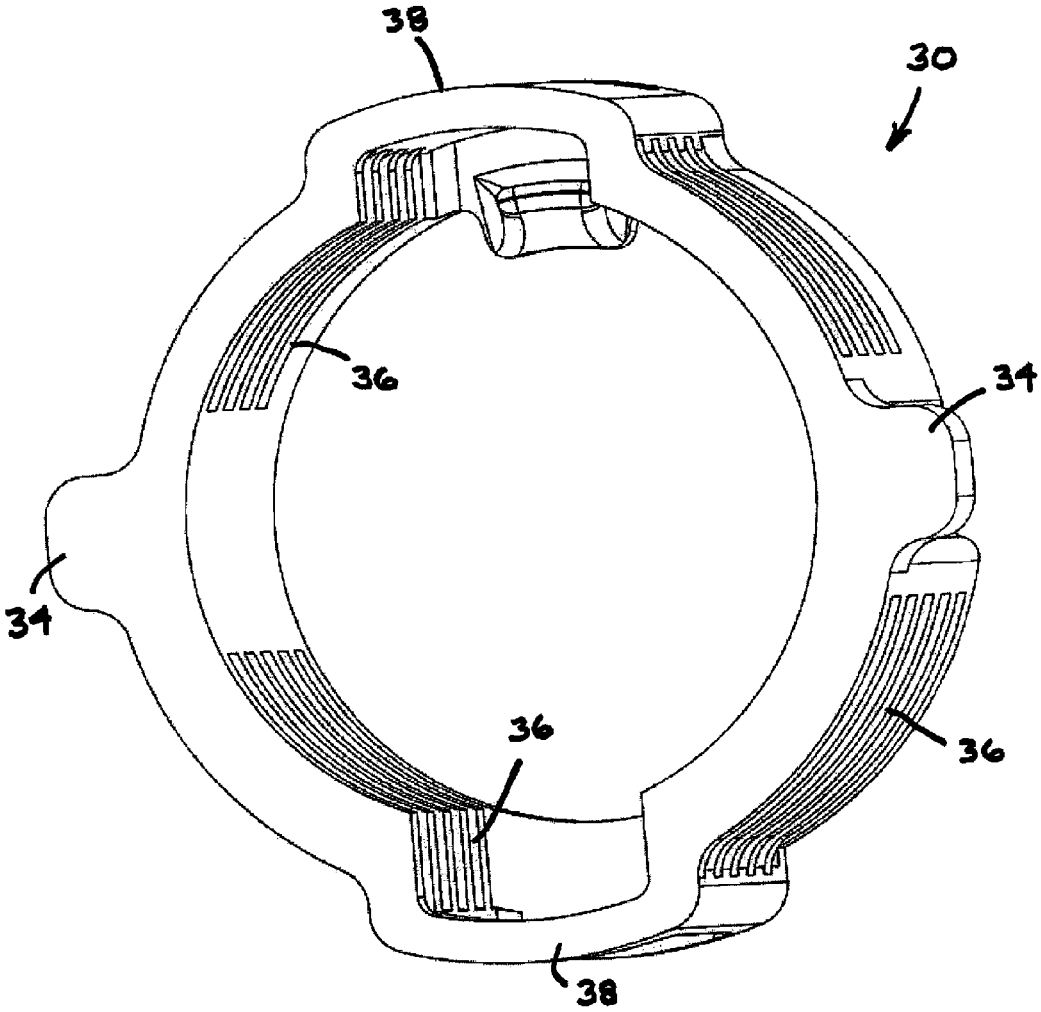
FIG. 2 is an enlarged front, top and right-side perspective view of the sleeve of the master keying lock illustrated in FIG. 1.

As shown, the system 10 includes a case 20 and a sleeve 30, the sleeve 30 being dimensioned to be slidably received within the case 20. Means for axially moving the sleeve 30 within the case 20 is also provided. Specifically, the sleeve 30 is spring-loaded and can move axially within the case 20 thereby changing positions depending on the specific key that is inserted into the lock cylinder 40. Springs 2 are disposed to either side of the sleeve 30 and are effectively captured and retained within grooves 32 formed within the sleeve 30 and complementary grooves 22 that are defined within the case 20. A stop member 34 is provided to one end of each of the sleeve grooves 32 which provides a surface against which a spring 2 can seat. A similar structure (not shown) is formed within the case 20. Circumferential rotation of the sleeve 30 within the case 20 is prevented by engagement between axial ribs 38 of the sleeve 30 and complementary slots 26 within the case 20. See also FIG. 2.

Figure 3:
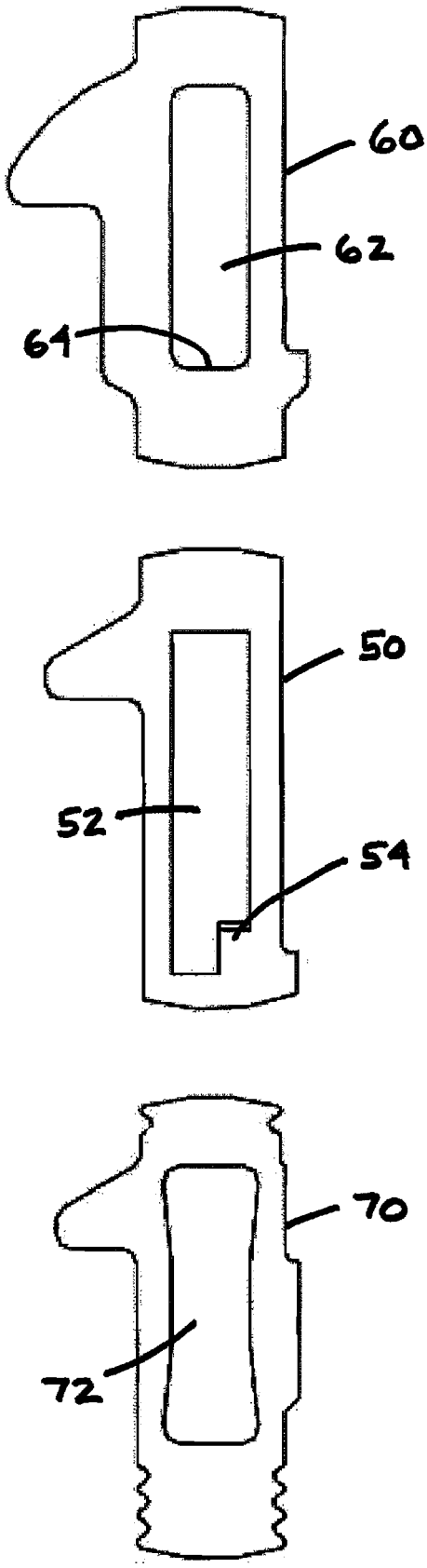
FIG. 3 is an enlarged front elevational view of the tumblers illustrated in FIG. 1.

The system 10 of the first preferred embodiment also comprises a lock cylinder 40 of the type that can be used to effect movement of a latch element (not shown) that is operatively connected to the lock cylinder 40. In this first preferred embodiment, the lock cylinder 40 includes three different types of "wafers" or tumblers within the cylinder 40. Specifically, the tumblers comprise a drive tumbler 50, two master tumblers 60 and five locking/unlocking tumblers 70. See also FIG. 3. It is to be noted that the number of master tumblers 60 and the numbers of locking/unlocking tumblers 70 may vary without deviating from the scope of the present invention. There may actually be any number of master tumblers 60 and locking/unlocking tumblers 70 within the first preferred embodiment of the present invention.

The locking/unlocking tumblers 70 and the master tumblers 60 are spring-loaded (not shown) in the same direction. The drive tumbler 50 is spring-loaded (also not shown) on the opposite side. It should also be noted that the drive tumbler 50 includes a protrusion 54 within the key window 52, the purpose and function of which will be discussed later in this detailed description. Again, see FIG. 3. With respect to the master tumbler 60, the key, when inserted, is intended to ride on the bottom edge 64 of the key window 62.

Figure 4:
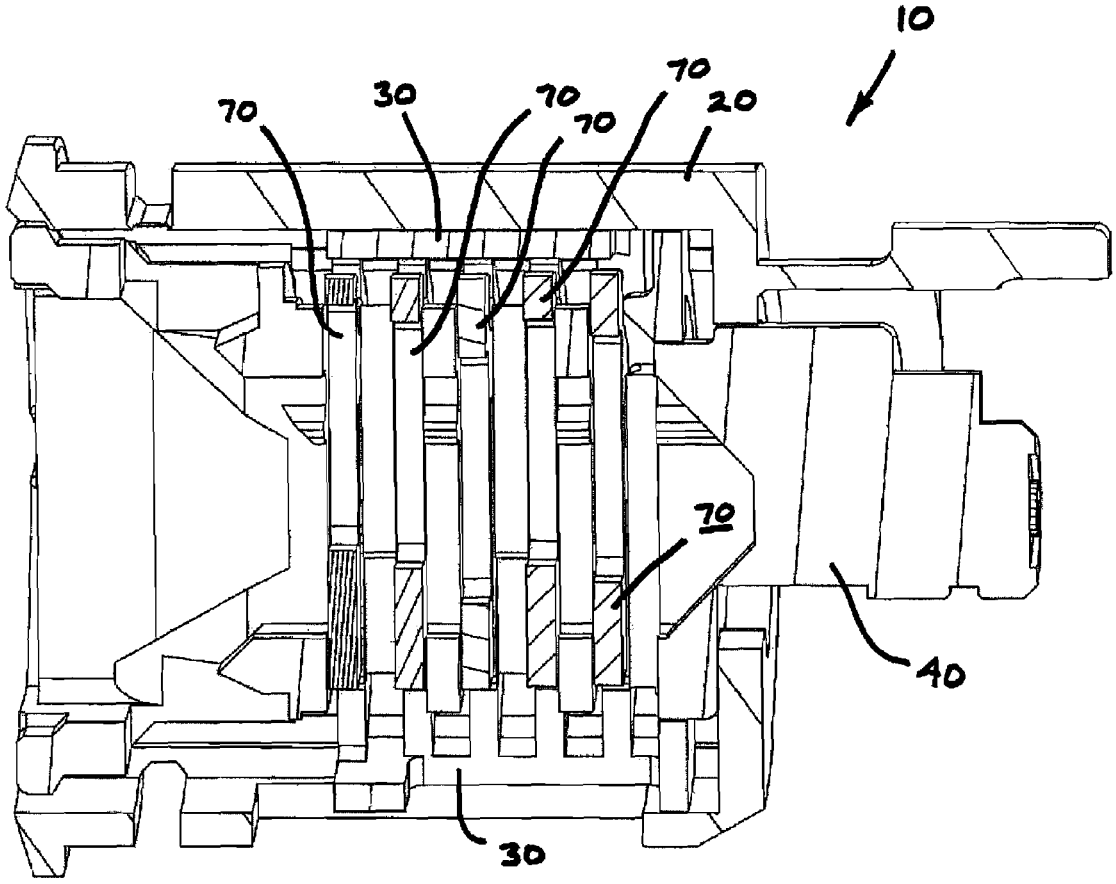
FIG. 4 is a cross-sectioned side elevational view of the lock illustrated in FIG. 1 and showing the tumblers and sleeve in the "locked" or "key out" position.
Figure 5:
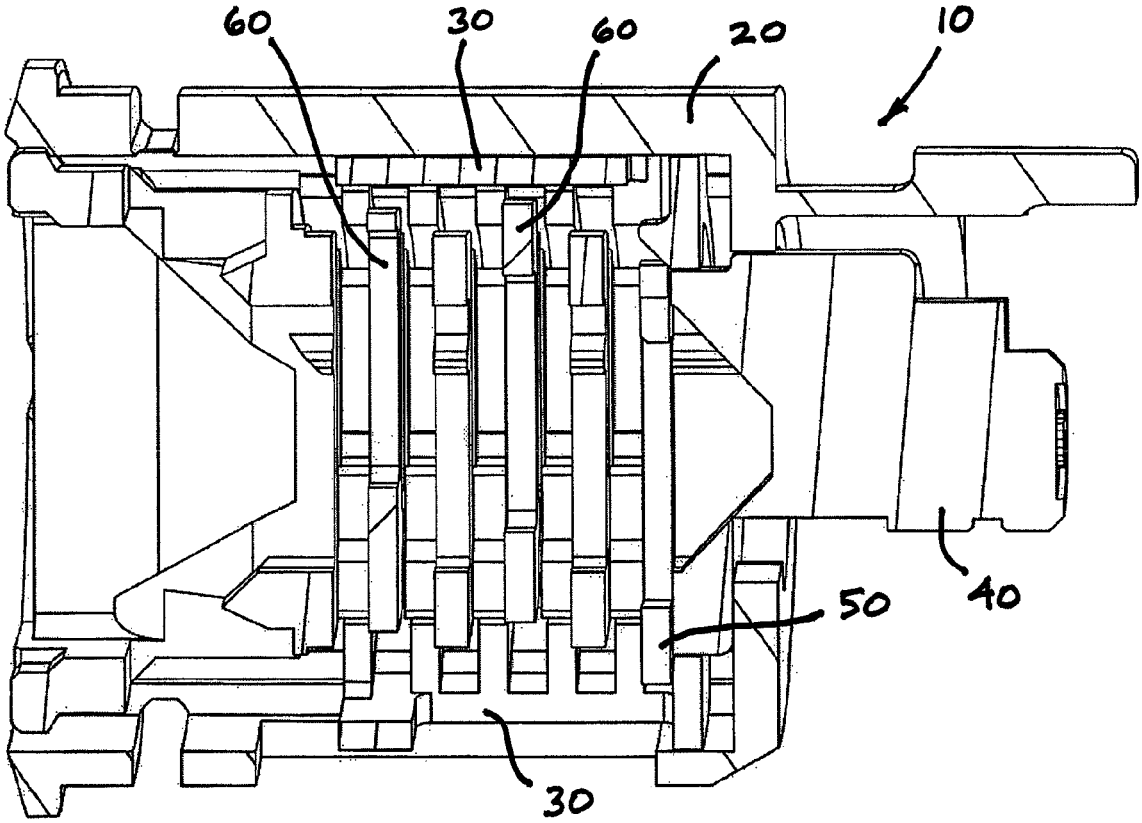
FIG. 5 is a view of the lock illustrated in FIG. 4 and showing added detail.

Referring now to FIG. 4, it shows the position of the tumblers 50, 60, 70 and the sleeve 30 in the "locked" or "key out" position. As illustrated, it will be appreciated that the locking/unlocking tumblers 70 engage the sleeve 30 and do not allow rotation. The master tumblers 60 and the drive tumbler 50 do not engage the sleeve 30. See FIG. 5.

Figure 6:
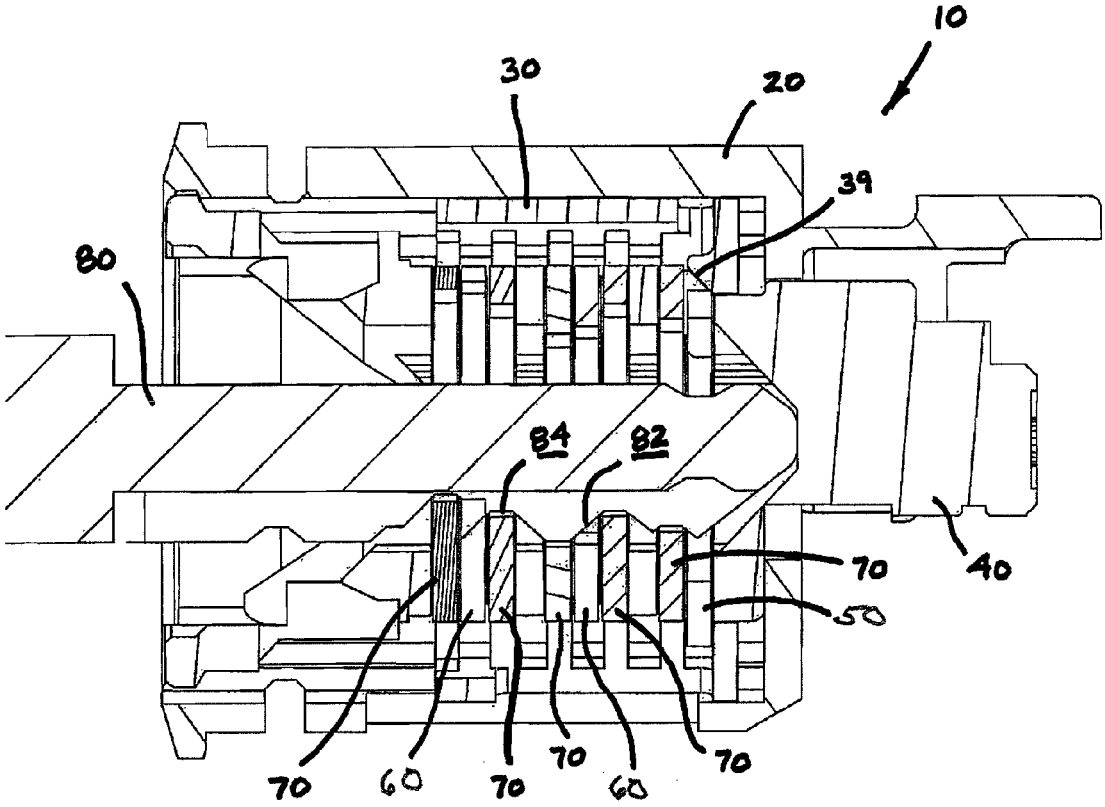
FIG. 6 is a cross-sectioned side elevational view of the lock illustrated in FIG. 4 and showing the tumblers and sleeve in the "unlocked" or "key in" position with a standard key.

Referring now to FIG. 6, it shows the "unlocked" position of the system 10 during normal key operation. As shown, the key 80 has a profile 82 of key notches 84 defined within it. In the unlocked position, the locking/unlocking tumblers 70 "drop" to the unlocked position within the body of the cylinder 40. The master tumblers 60 move to unknown positions between the key notches 84. This allows them to rotate through slots 36 defined within the sleeve 30. Note that the key 80 does not touch the drive tumbler 50 although the drive tumbler 50 is allowed to rotate through a slot 36 in the sleeve 30 as well.

Figure 7:
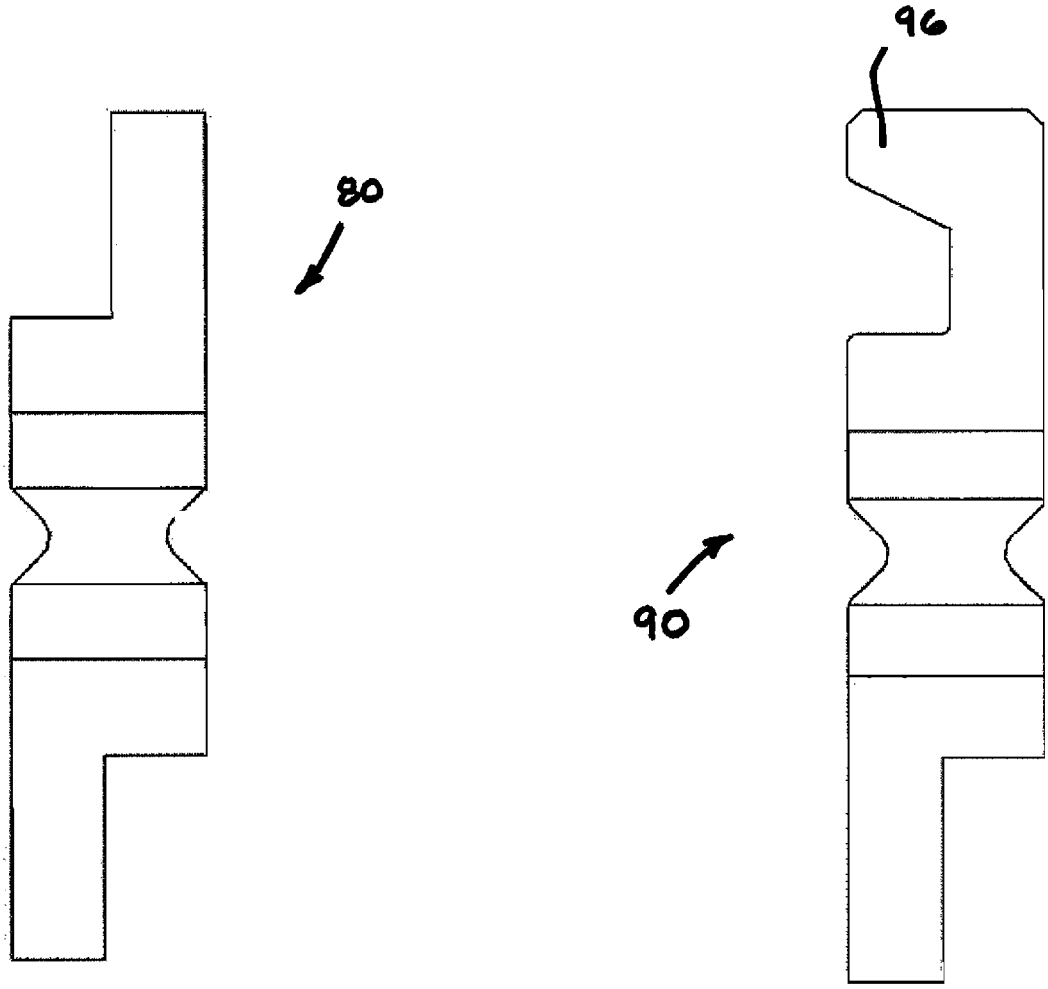
FIG. 7 is a drawing illustrating the profiles for the keys that would be used with the lock illustrated in FIG. 1.

In this first preferred embodiment, a master key 90 having an edge profile 92 as shown in FIG. 7 is provided. Its profile 92 is compared to the standard key 80 as shown in the same FIG. 7. It should also be mentioned that any number of keys 80 and master keys 90 may be used with the present invention, a single key not being a limitation of the present invention. The key way 42 in the cylinder 40 is, however, modified to allow access to the drive tumbler 50 by means of the master key 90, the master key 90 having a protrusion 96 defined within it. Note that insertion of the standard key 80 does not touch the drive tumbler 50. The drive tumbler 50 is, however, dropped by insertion of the master key 90.

Figure 8:
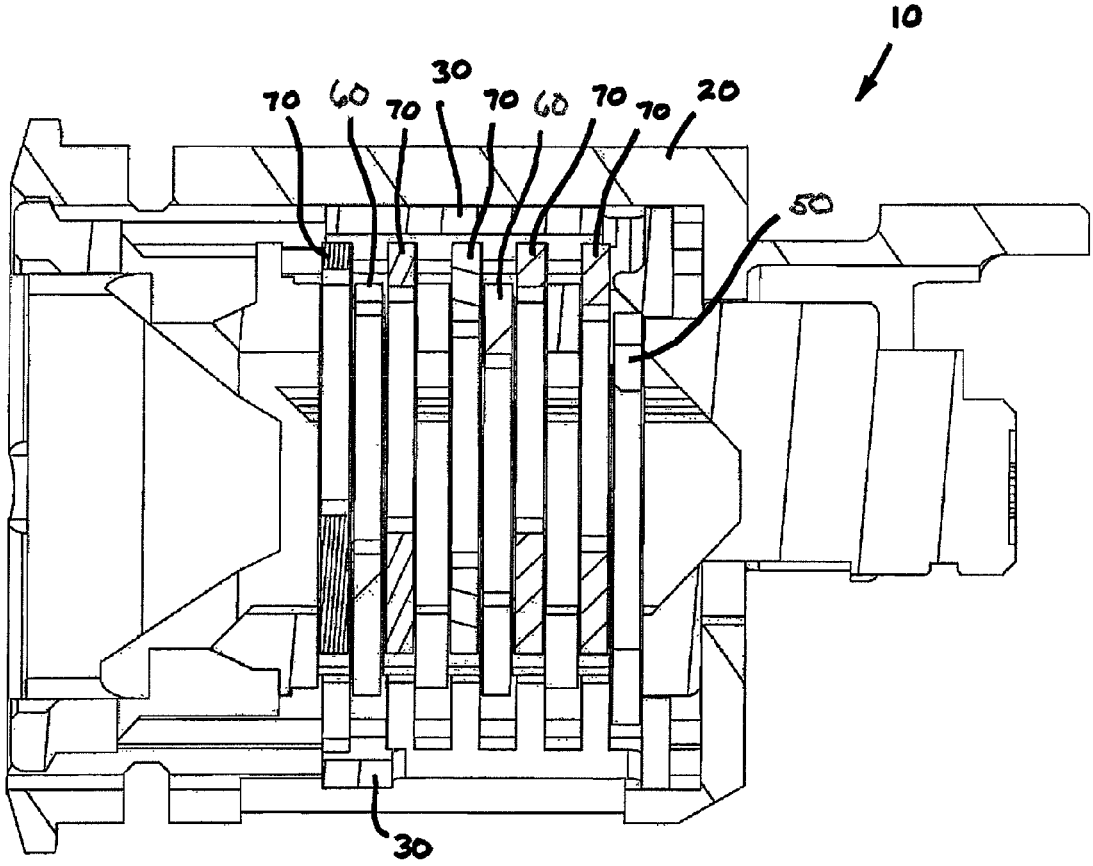
FIG. 8 is a cross-sectioned side elevational view and showing the detail of the sleeve and drive tumbler in the "key out" position.
Figure 9:
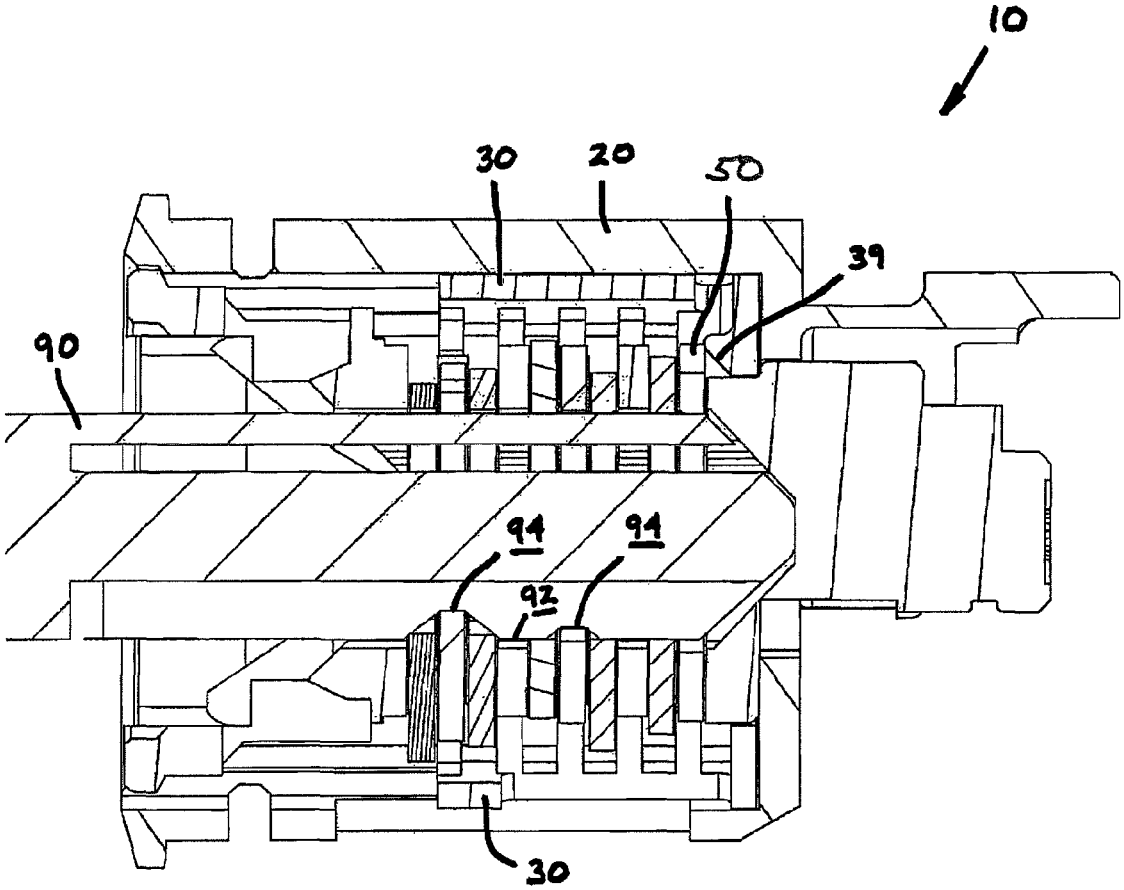
FIG. 9 is a view similar to FIG. 8 and showing the master key interaction with the drive tumbler.
Figure 10:
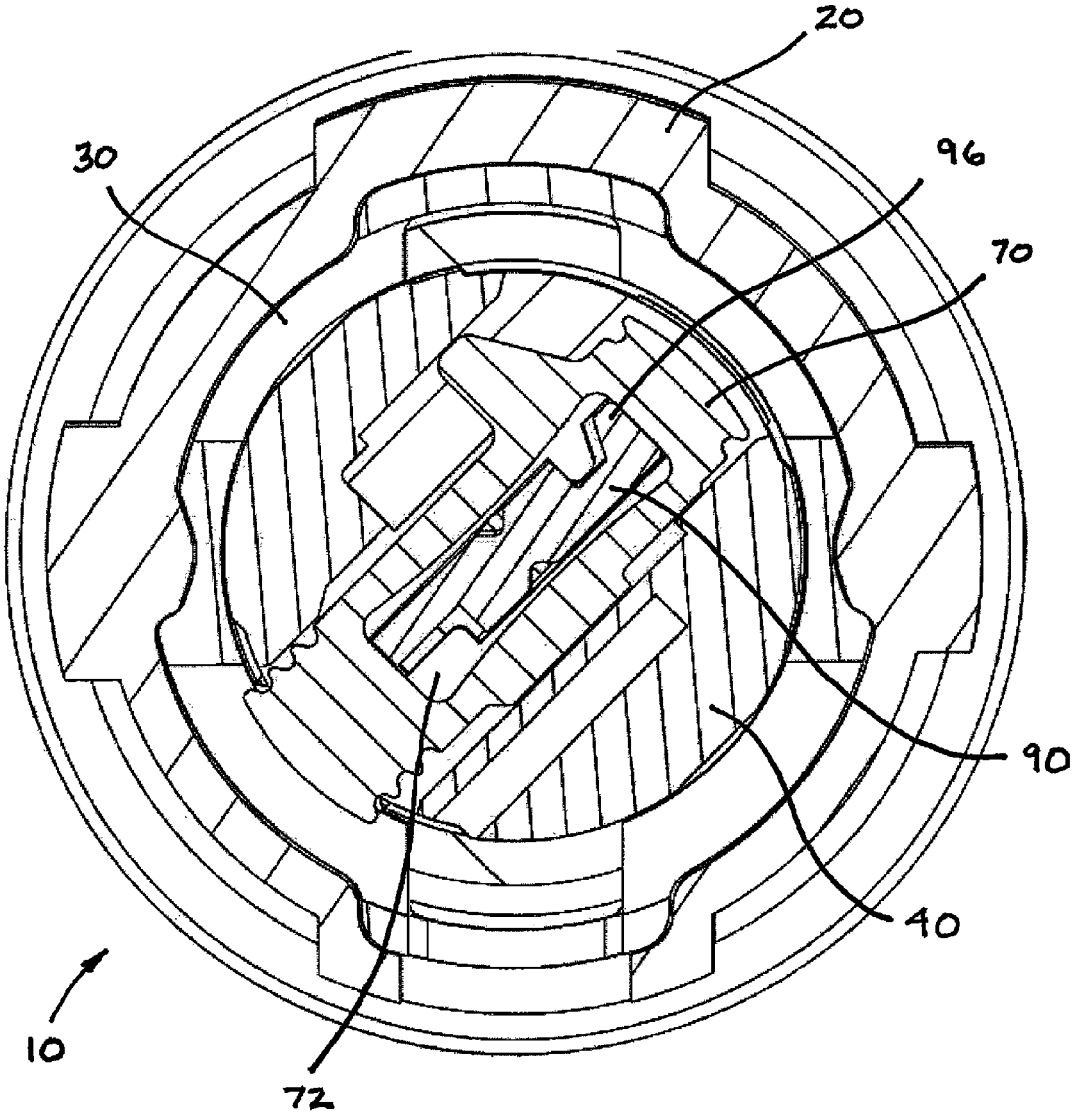
FIG. 10 is a cross-sectioned and front elevational view of the lock shown in FIG. 9 following rotation of the master key.

Relative to the operation of the master key 90, it will be noted in FIG. 8 that, in the "key out" position, the drive tumbler 50 sits below a ramp 39 in the sleeve 30. In that configuration, the locking/unlocking tumblers 70 are engaged in the sleeve 30 and the lock cylinder 40 cannot rotate. Insertion of the master key 90 causes the drive tumbler 50 to be driven into the sleeve ramp 39, resulting in the sleeve 30 being moved rearwardly. See FIG. 9. In this "rearward position" of the sleeve 30 as shown, the master tumbler 60 engages the sleeve 30 and lines up with key notches 94 on the master key 90. The lock cylinder 40 will not rotate unless proper master key notches 94 are present. Further, the locking/unlocking tumblers 70 no longer engage the sleeve 30 and are allowed to rotate through the slots 36 defined within the sleeve 30. See also FIG. 10.

In summary, it will be seen that the master keying arrangement in this first preferred embodiment of the present invention is accomplished is by use of the axially-movable sleeve 30. The sleeve 30 shifts the locking surface engaging either the locking/unlocking tumblers 70 or the master tumblers 60. Sleeve 30 shifts can only be accomplished by use of the master key 90. Standard keys 80 do not contact the drive tumbler 50 which shifts position of the sleeve 30 when inserted as described above. In the standard operation, the correct key profile 82 and key notching 84 must be present to rotate the lock cylinder 40 within the sleeve 30. In the master key operation, the correct key notching for the master tumblers 60 as well as the drive surface for the drive tumbler 50 must be present to rotate the cylinder 40. Again, see FIG. 10.

Figure 11:
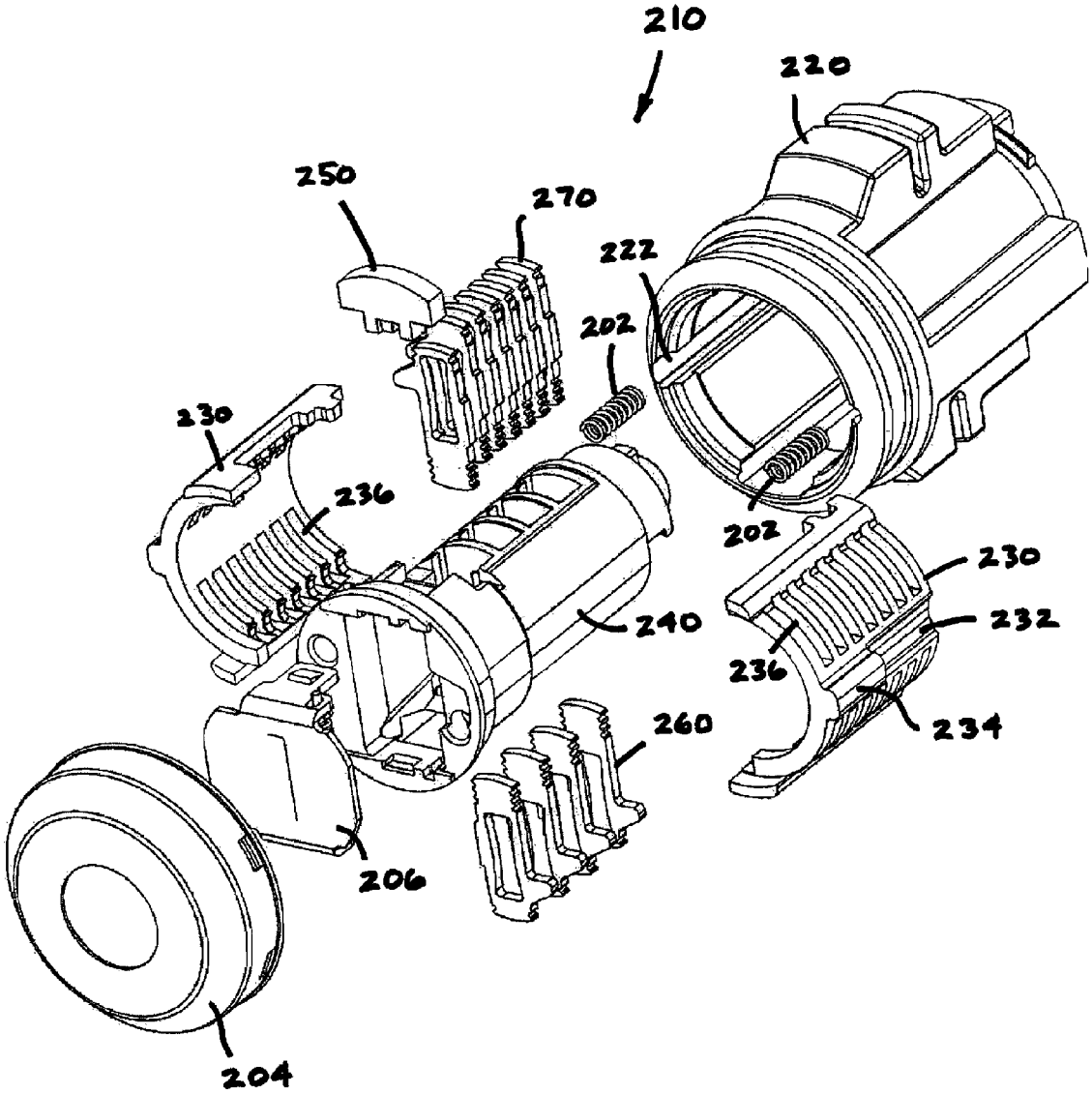
FIG. 11 is an exploded front, top and right-side perspective view of the second embodiment of a master keying lock constructed in accordance with the present invention.

Referring now to FIG. 11, it illustrates a perspective view of a second preferred embodiment of a master keying system, generally identified 210, that is constructed in accordance with the present invention. As shown, the system 210 similarly includes a case 220 and a sleeve 230, the sleeve 230 also being dimensioned to be slidably received within the case 220 and being formed of two half members, although such is not a limitation of the present invention. Means for axially moving the sleeve 230 within the case 220 is also provided. Specifically, the sleeve 230 is spring-loaded and can move axially within the case 220 thereby changing positions depending on the specific key that is inserted into the lock cylinder 240. Springs 202 are disposed to either side of the sleeve 230 and are captured within grooves 232 formed within the sleeve 230 and complementary grooves 222 that are defined within the case 220. A stop member 234 is provided to one end of each of the sleeve grooves 232 which provides a surface against which the spring 202 can seat. A similar structure (not shown) is formed within the case 220. Circumferential rotation of the sleeve 230 within the case 220 is likewise prevented by structure that is similar to that of the first preferred embodiment discussed above. As will be apparent later in this detailed description, the system 210 of the second preferred embodiment of the present invention achieves its functionality by adjusting tumbler locking surfaces based on whether a "standard" key or a "master" key is used with the sleeve 230.

The system 210 of the second preferred embodiment also comprises a cap 204 and a keyway shutter assembly 206, both of which are preferred but not essential to the present invention. More importantly, the system further comprises a lock cylinder 240 and a shim 250. The lock cylinder 240 includes two different types of tumblers within it. Specifically, the tumblers comprise a plurality of "master" tumblers 260 and a plurality of "standard" locking/unlocking tumblers 270, the precise number of tumblers 260, 270 not being a limitation of the present invention. In point of fact, one added benefit of using the tumblers 260, 270 of the second preferred embodiment is that each is simply an inverted version of the other, which is a manufacturing expediency. As before, the master tumblers 260 and the standard locking/unlocking tumblers 270 are spring-loaded (not shown) but are biased in opposite directions.

Figure 12:
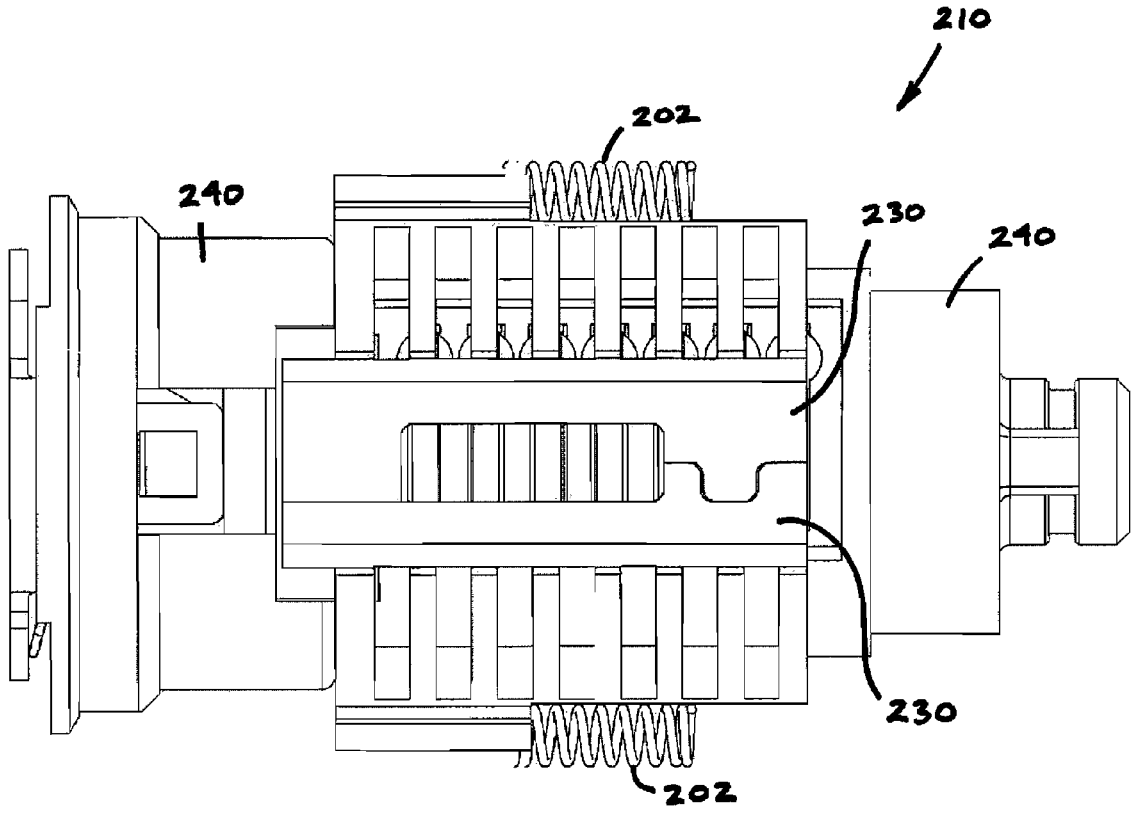
FIG. 12 is a top plan view of the unexploded lock system shown in FIG. 11.
Figure 13:
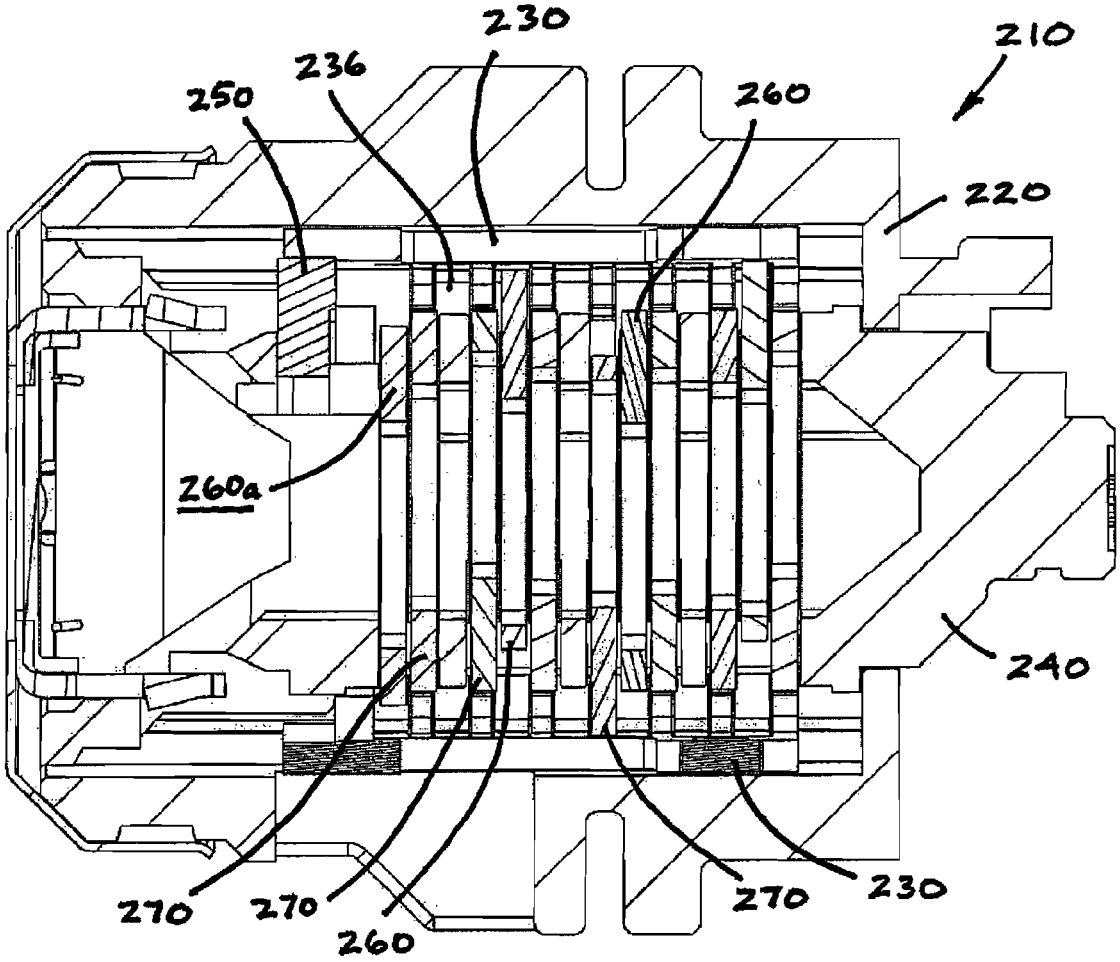
FIG. 13 is a cross-sectioned a side elevational view of the lock system illustrated in FIG. 12 and showing the shim and tumblers where the master key is extracted.
Figure 14:
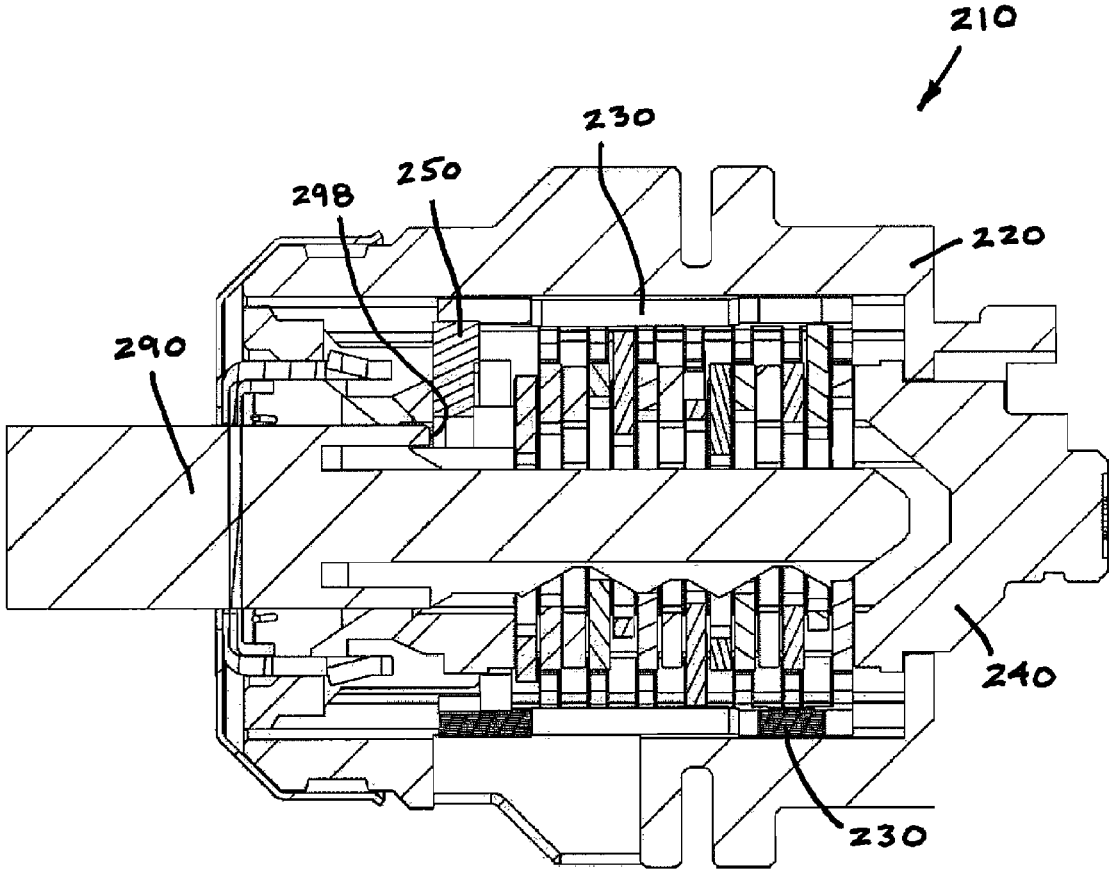
FIG. 14 is a cross-sectioned a side elevational view of the lock illustrated in FIG. 12 and showing initial insertion of the master key.
Figure 16:
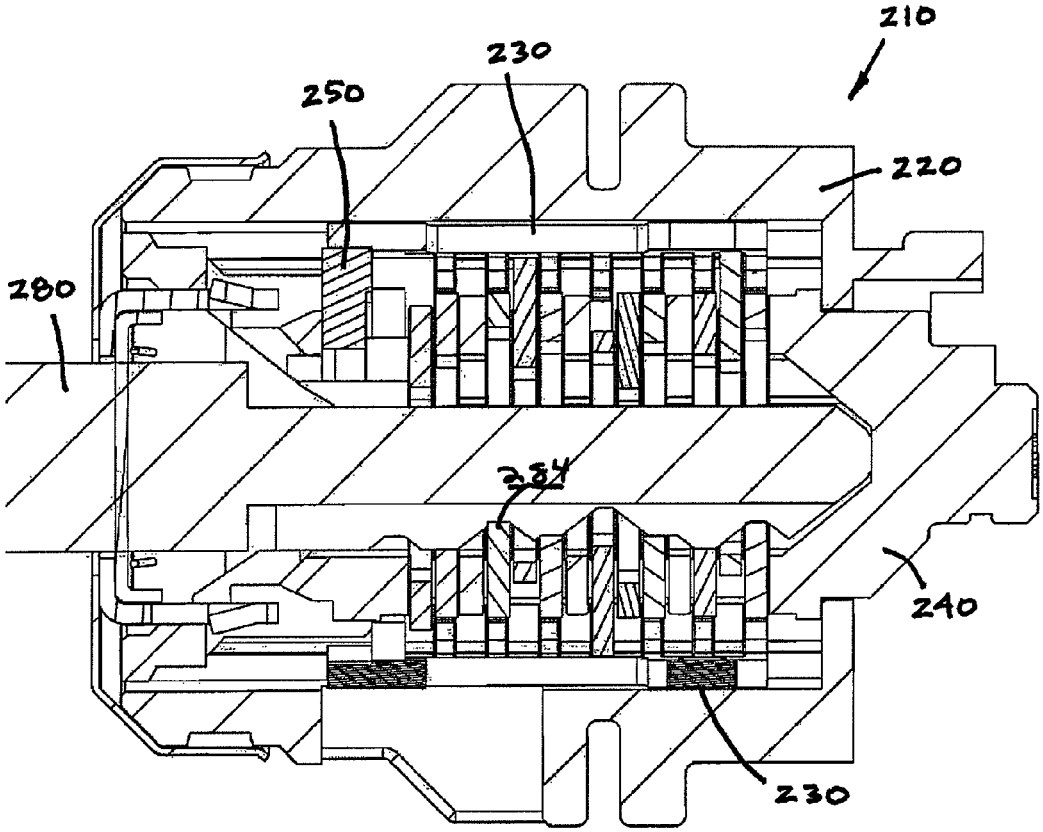
FIG. 16 is a cross-sectioned a side elevational view of the lock illustrated in FIG. 12 and showing full insertion of the standard key.
Figure 17:
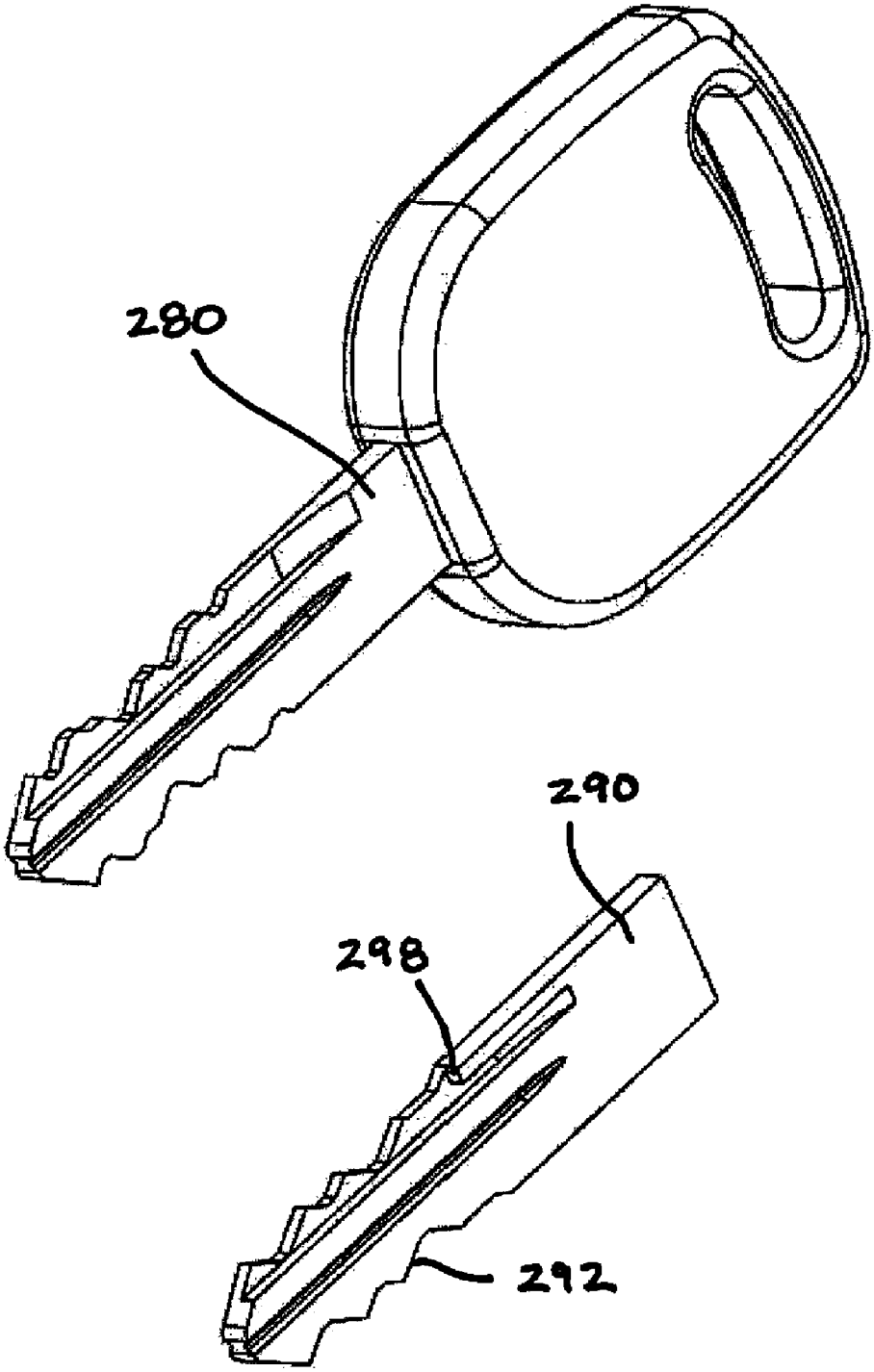
FIG. 17 is a perspective view of the key profiles for the keys that would be used with the lock illustrated in FIG. 11.

Referring now to FIG. 12, it shows the position of the shim 250 and tumblers 260, 270 and the sleeve 230 in the "locked" or "key out" position, where the "master" key is extracted. In this mode, the sleeve 230 creates a locking surface with the standard locking/unlocking tumblers 270. See FIG. 13. When the correct "master" key 290 is inserted, this retracts the first master tumbler 260*a*, allowing both the shim 250 and the sleeve 230 to freely travel axially relative to the cylinder 240 when a master key member or "flat" 298 contacts the shim 250. See FIG. 14. Note that the standard key 280 does not have this member or flat 298. See FIGS. 16 and 17.

Figure 15:
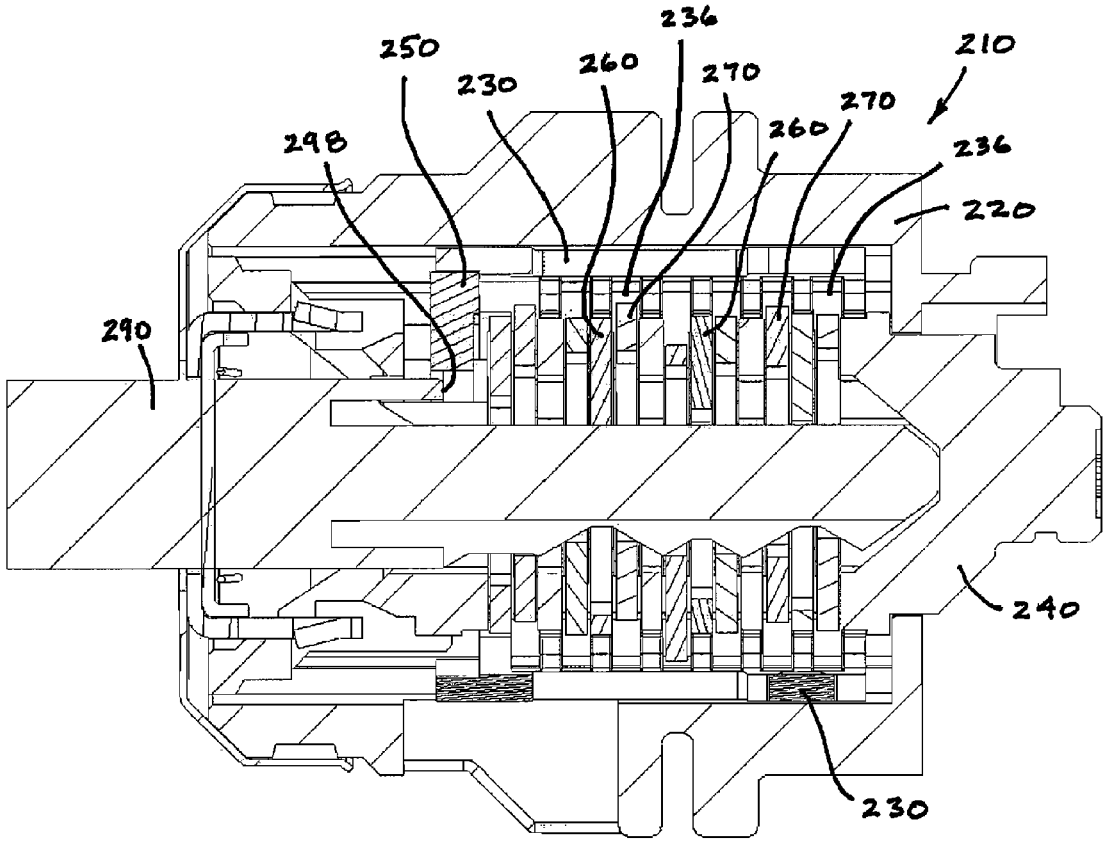
FIG. 15 is a cross-sectioned a side elevational view of the lock illustrated in FIG. 12 and showing full insertion of the master key.

As shown in FIG. 15, it will be seen that full insertion of the master key 290 into the cylinder 240 shifts the sleeve 230 away from the cap 204 and shutter assembly 206. The locking surface 292 of the master key 290 now interacts with the master tumblers 260 whereas the standard tumblers 270 are allowed to pass through the slots 236 in the sleeve 230. Since the standard key 280 does not have the flat 298 to urge the shim 250 inwardly, the standard locking/unlocking tumblers 270 engage the sleeve 230 whereas the master tumblers 260 are allowed to travel through the slots 236 of the sleeve 230 during rotation of the key 280. Again, see FIG. 16.

Figure 18:
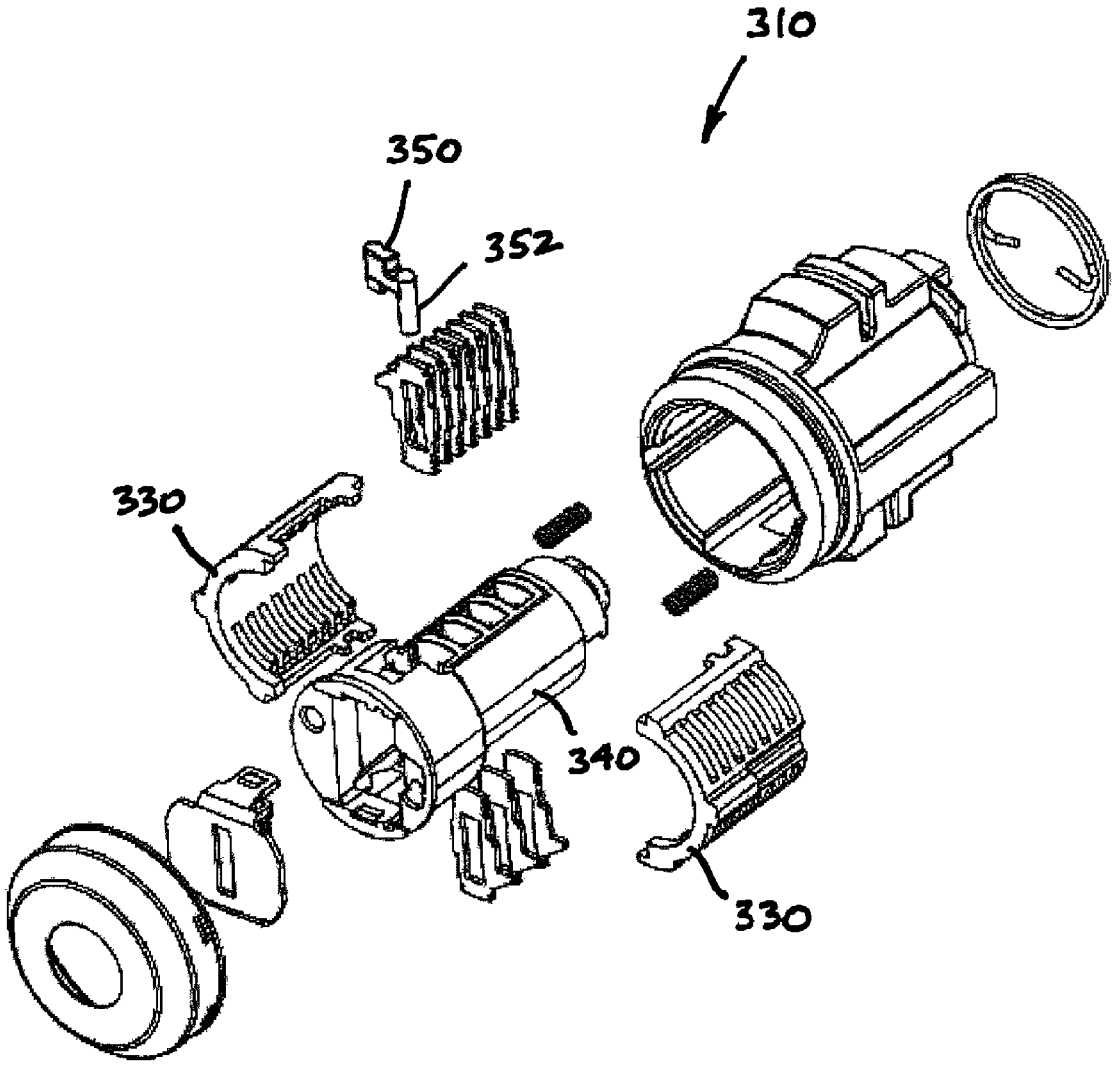
FIG. 18 is an exploded front, top and right-side perspective view of the third embodiment of a master keying lock constructed in accordance with the present invention.
Figure 19:
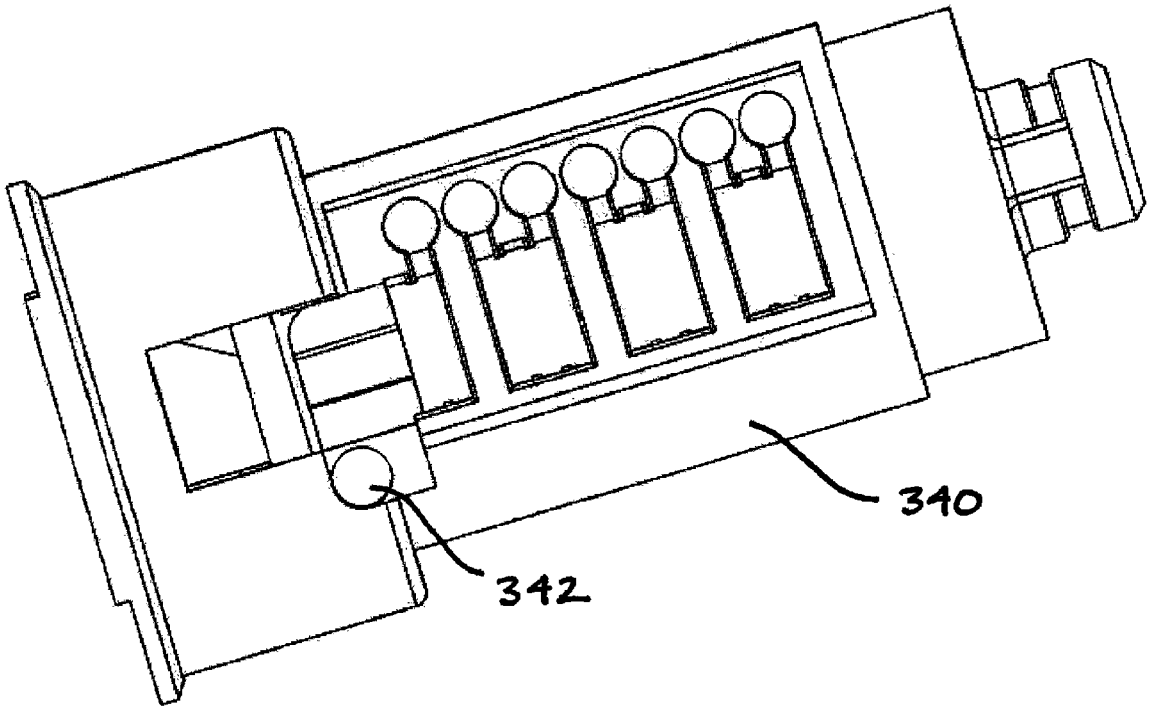
FIG. 19 is a top plan view of the lock cylinder of the lock shown in FIG. 18.
Figure 20:
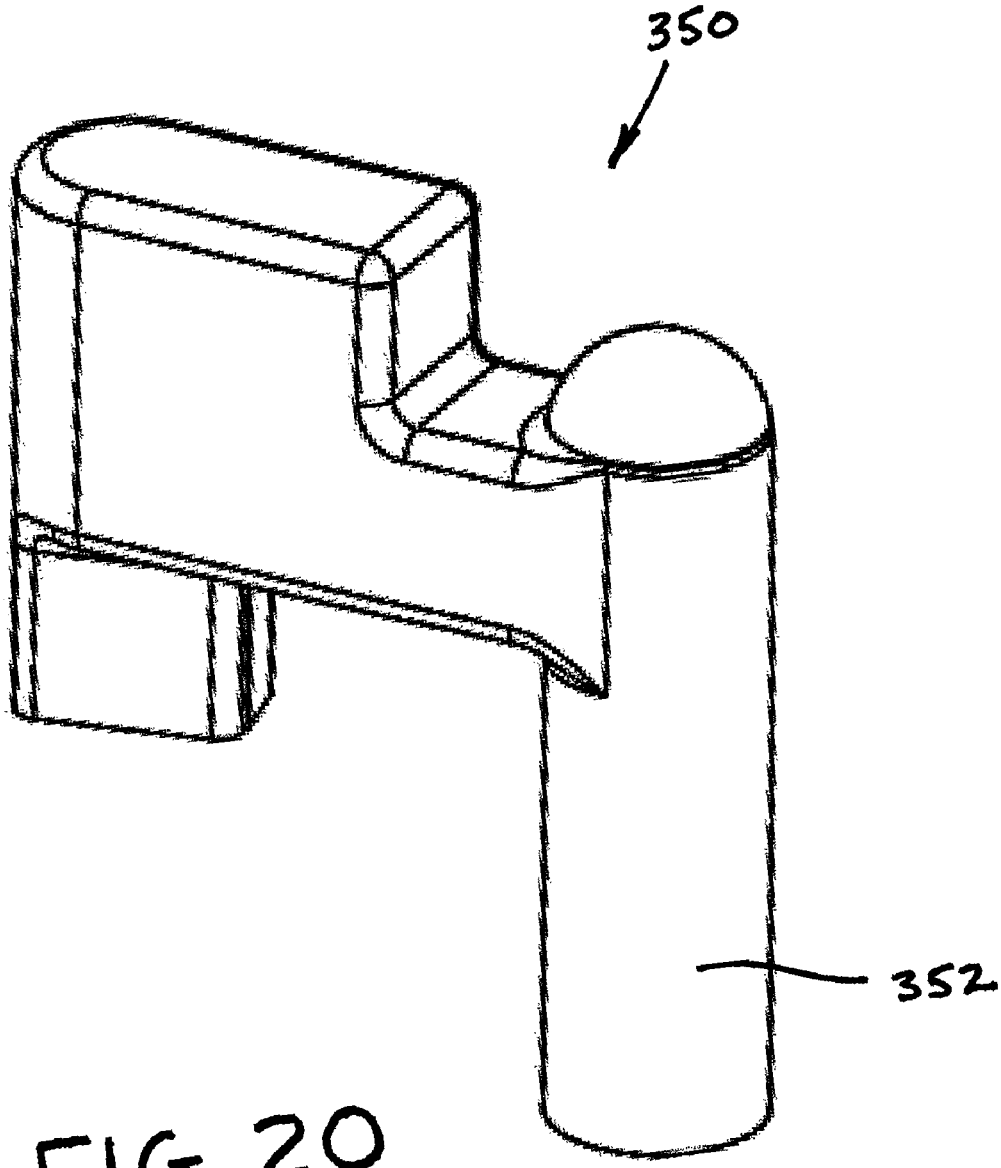
FIG. 20 is a perspective view of a pivot shim used in the lock illustrated in FIG. 18.

A third preferred embodiment is also contemplated within the scope of the present invention. Referring now to FIGS. 18 through 20, it will be seen that this third system 310 an alternative structure to the shim 250 of the second system 210 is presented. Specifically, the shim 250 is replaced by a "pivot" shim 350, the pivot shim 350 having a post 352 that is rotatable within an aperture 342 defined within the lock cylinder 340. Aside from rotating about its post 352, the shim 350 functions in the same way to move the sleeve 330 in an axial direction when a master key 290 is used with the system 310.

In summary, it will be seen that the master keying arrangement in the second and third embodiments of the present invention is likewise accomplished by use of an axially-movable sleeve 230, 330. The sleeves 230, 330 shift the locking surface engaging either the locking/unlocking tumblers 270, 370 or the master tumblers 260, 360. Sleeve 230, 330 shifts can only be accomplished by use of the master key 290. The standard key 280 does not contact the shims 250, 350 which shift position of the sleeves 230, 330 when inserted as described above. In the standard operation, the correct key notching 284 must be present to rotate the lock cylinders 240, 340 within the sleeves 230, 330, respectively. In the master key operation, the correct key notching for the master tumblers 260, 360 as well as the surface 298 of the master key 290 must be present to contact the shims 250, 350 thus allowing rotation of the cylinders 240, 340.

Based upon the foregoing, it will be seen that there has been provided a new and useful master keying lock, system and method that provides for a master keying system which allows the lock to be unlocked with the original key provided for the lock as well as with a master key. It further provides use of existing tumblers and key of the lock and also allows for "backwards compatibility" of those elements. All of this is accomplished by use of a master keying feature that uses a moveable sleeve that shifts the locking surface within the lock casing relative to wafer tumblers that are used within the lock.

The details of the invention having been disclosed in accordance with the foregoing, we claim:

1. A master key lock comprising:

a lock cylinder having a keyway for receiving a key;

a circumferential sleeve, the circumferential sleeve being axially movable along the lock cylinder and the circumferential sleeve further comprising a plurality of transverse slots; and wherein the lock further comprises a plurality of wafer tumblers comprising unlocking/locking tumblers, a plurality of master tumblers and a drive tumbler, the drive tumbler having a window and a protrusion into the window and including a master key comprising a portion that contacts the protrusion to drop the drive tumbler, the wafer tumblers are transversely movable to engage the sleeve slots wherein insertion of the master key moves the sleeve and realigns the wafer tumblers relative to the sleeve slots about the lock cylinder;

means for preventing circumferential rotation of the sleeve about the cylinder;

a shim; and the master key comprising a point for contacting the shim, the shim contacting the sleeve upon insertion of the master key for moving the sleeve and unlocking the lock when the master key is inserted into the keyway.

2. The master key lock of claim 1 wherein the plurality of unlocking/locking tumblers and the plurality of master tumblers are similarly configured but inverted.

3. The master key lock of claim 1 wherein the shim comprises a pivoting member having a pivot point located along the lock cylinder.

4. A system for using the master key lock of claim 1 further comprising a lock case wherein the sleeve is disposed between the lock cylinder and the case.

5. The system of claim 4 wherein the plurality of unlocking/locking tumblers and the plurality of master tumblers are similarly configured but inverted.

6. The system of claim 5 wherein the shim comprises a pivoting member having a pivot point located along the lock cylinder.

7. A master key lock system comprising:

a lock case;

a lock cylinder having a keyway for receiving a key, the lock cylinder defining a keyway axis;

a circumferential sleeve disposed between the lock cylinder and the case, the sleeve being axially movable within the case and further comprising a plurality of transverse and spaced slots defined within the sleeve;

a plurality of wafer tumblers comprising a plurality of locking/unlocking tumblers, a plurality of master tumblers and a drive tumbler, the drive tumbler having a window and a protrusion into the window, the plurality of locking/unlocking tumblers and the plurality of master tumblers being similarly configured but inverted, each of the plurality of wafer tumblers being transversely movable relative to the keyway axis;

a master key comprising a portion that contacts the protrusion of the drive tumbler and point for contacting a shim;

the shim being operable to move the sleeve axially within the case when the master key is inserted into the keyway;

wherein insertion of the master key moves the shim and the sleeve and realigns the wafer tumblers relative to the slots of the sleeve.

8. The master key lock system of claim 7 wherein the shim comprises a pivoting member having a pivot point located along the lock cylinder.

* * * * *